US007347499B2

(12) United States Patent
Slabaugh et al.

(10) Patent No.: US 7,347,499 B2
(45) Date of Patent: Mar. 25, 2008

(54) MARINE SEAT INTERCHANGEABLE COMPONENT ASSEMBLY AND METHOD

(75) Inventors: Anthony L. Slabaugh, Belmont, MI (US); Jason E. Begin, Rockford, MI (US); Donald J. Olsen, Greenville, MI (US)

(73) Assignee: Attwood Corporation, Lowell, MI (US)

( * ) Notice: Subject to any disclaimer, the term of this patent is extended or adjusted under 35 U.S.C. 154(b) by 0 days.

(21) Appl. No.: 10/965,558

(22) Filed: Oct. 14, 2004

(65) Prior Publication Data

US 2006/0082211 A1 Apr. 20, 2006

(51) Int. Cl.
*A47C 7/02* (2006.01)

(52) U.S. Cl. ..... 297/452.56; 297/452.65; 297/DIG. 2; 297/284.11

(58) Field of Classification Search ..... 297/452.65, 297/284.11, DIG. 2, 440.14, 411.26, 411.27, 297/411.28, 411.29, 440.1, 440.23, 451.11, 297/451.8
See application file for complete search history.

(56) References Cited

U.S. PATENT DOCUMENTS 1,243,958 A 10/1917 McFarland
2,015,315 A 9/1935 McMackin
2,279,864 A * 4/1942 Eide ..... 211/189
2,294,039 A 8/1942 Looney
2,383,125 A 8/1945 Hill
2,429,050 A 10/1947 Decker
2,759,529 A 8/1956 Hagadom
3,088,771 A 5/1963 Weigle
3,172,713 A 3/1965 Rupert
3,266,843 A * 8/1966 Feder ..... 297/440.16
3,467,425 A 9/1969 Ferrara
3,596,987 A 8/1971 Wilson
3,600,037 A * 8/1971 Lohr ..... 297/284.11
3,615,115 A 10/1971 Buxton
3,669,495 A * 6/1972 Von Rudgisch ..... 297/451.11
3,669,496 A * 6/1972 Chisholm ..... 297/448.1
3,874,729 A * 4/1975 Blodee ..... 297/448.2
3,883,175 A * 5/1975 Rodaway ..... 297/411.28
4,133,579 A * 1/1979 Springfield ..... 297/452.65
4,318,570 A * 3/1982 Adam et al. ..... 297/450.1
4,619,623 A 10/1986 Elverskog
4,682,816 A * 7/1987 Massonnet ..... 297/359
4,818,016 A * 4/1989 Mariol et al. ..... 297/174 CS
4,836,602 A 6/1989 d'Almada et al.
4,869,551 A 9/1989 Lathers
4,902,072 A * 2/1990 Chancellor, Jr. ..... 297/411.32
5,004,295 A 4/1991 Inoue
5,102,196 A * 4/1992 Kaneda et al. ..... 297/452.15
5,149,173 A 9/1992 Jay et al.

(Continued)

*Primary Examiner*—David Dunn
*Assistant Examiner*—Erika Garrett
(74) *Attorney, Agent, or Firm*—Price, Heneveld, Cooper, DeWitt & Litton, LLP

(57) ABSTRACT

A seat for marine use including a hollow primary seat structure. The primary seat structure has a generally upright back portion and a seat portion formed integrally with the back portion and extending forwardly therefrom. The back portion includes at least a pair of first female connector structures, and the seat portion includes at least a pair of second female connector structures. The seat further includes a pair of armrests having integral hook-shaped connectors at first ends thereof. The hook-shaped connectors are received in the first female connectors of the primary seat structure. The armrests also include integral male connectors at second ends that are received in the second female connector structures of the primary seat structure.

10 Claims, 11 Drawing Sheets

U.S. PATENT DOCUMENTS 5,292,174 A 3/1994 Ohnuma
5,358,307 A 10/1994 Shafer et al.
5,518,298 A * 5/1996 LaPointe et al. ..... 297/463.1
5,560,681 A * 10/1996 Dixon et al. ..... 297/284.11
5,597,203 A * 1/1997 Hubbard ..... 297/284.3
5,599,068 A * 2/1997 Kelly et al. ..... 297/448.1
5,658,047 A 8/1997 Ratza et al.
5,716,099 A * 2/1998 McDiarmid ..... 297/302.1
5,746,479 A * 5/1998 Bodnar ..... 297/411.26
5,769,498 A 6/1998 Smith et al.
5,810,438 A * 9/1998 Newhouse ..... 297/286
5,820,221 A 10/1998 Greaves et al.
5,863,092 A 1/1999 Kifer
D411,381 S 6/1999 Greaves et al.
5,913,533 A 6/1999 Lucas, Jr. et al.
5,931,527 A 8/1999 D'Onofrio et al.
5,988,746 A * 11/1999 Raftery ..... 297/297
5,992,936 A 11/1999 Greaves
6,059,358 A 5/2000 Demick et al.
6,131,993 A 10/2000 Pesta et al.
6,164,724 A 12/2000 Greaves
6,199,948 B1 3/2001 Bush et al.
6,241,317 B1 * 6/2001 Wu ..... 297/440.23
6,283,552 B1 9/2001 Halse et al.
6,450,571 B1 9/2002 Canni et al.
6,554,365 B2 4/2003 Karschin et al.
6,568,760 B2 5/2003 Davis et al.
6,585,316 B2 7/2003 Kucera
6,607,240 B2 * 8/2003 Zheng ..... 297/16.2
6,688,699 B1 * 2/2004 Bowie ..... 297/440.14
6,702,375 B1 3/2004 Laskowski et al.
6,702,391 B1 * 3/2004 Stipek ..... 297/452.65
6,733,084 B2 5/2004 Butler
6,783,184 B2 * 8/2004 DiBattista et al. ..... 297/452.14
7,195,316 B2 * 3/2007 Shimasaki et al. ..... 297/284.11

* cited by examiner 5
52
55
51
50

55
5
57
58
56

51
54
59
50
5
55
56
53
52

5
50
51

XII
55
56
5
52
XI
XII
XI 55
5
50
51
52

MARINE SEAT INTERCHANGEABLE COMPONENT ASSEMBLY AND METHOD

BACKGROUND OF THE INVENTION

Various blow-molded seating configurations have been developed for marine use. Such seats may include a large blow-molded structure forming the back and seat. Such seats are generally limited to a single configuration, such that an entirely new seat design must be provided if a different seating configuration is required for a particular application.

SUMMARY OF THE INVENTION

One aspect of the present invention is a seat for marine use including a hollow primary seat structure. The primary seat structure has a generally upright back portion and a seat portion formed integrally with the back portion and extending forwardly therefrom. The back portion includes at least a pair of first female connector structures, and the seat portion includes at least a pair of second female connector structures. The seat further includes a pair of hollow molded armrests having integral hook-shaped connectors at first ends thereof. The hook-shaped connectors are received in the first female connectors of the primary seat structure. The armrests also include integral male connectors at second ends of the armrests that are received in the second female connector structures of the primary seat structure.

Another aspect of the present invention is a method of making a seat for marine use. The method includes hollow molding a primary seat structure having at least a pair of integrally molded first connector structures. The method also includes hollow molding at least a selected one of an armrest and a head rest having a second connector structure. The second connector structure is secured to the first connector structure, and at least a portion of the primary seat structure and the selected one of the armrest and head rest are upholstered.

Another aspect of the present invention is a seat for marine use including a hollow molded primary seat structure having a generally upright back portion defining an upper edge and generally vertical side edges. The primary seat structure includes a seat portion. The seat further includes an enlarged U-shaped hollow molded structure forming a combination armrest and head rest, and extends around the upper edge and the side edges of the back portion of the primary seat structure.

Yet another aspect of the present invention is a method of fabricating a seat for marine use. The method includes hollow molding a seat structure having an upright back portion and a seat portion. A first armrest is hollow molded, and includes a first body defining a first shape that provides a first visual appearance. A second armrest is hollow molded, and has a second body defining a second shape that provides a second visual appearance that is substantially different than the first appearance. A selected one of the first and second armrests is connected to the seat structure.

These and other features, advantages, and objects of the present invention will be further understood and appreciated by those skilled in the art by reference to the following specification, claims, and appended drawings.

BRIEF DESCRIPTION OF THE DRAWINGS

FIG. 5B;

FIG. 5A;

FIG. 5A;

FIG. 5B;

FIG. 13;

FIG. 13;

DETAILED DESCRIPTION OF PREFERRED EMBODIMENT

Figure 3:
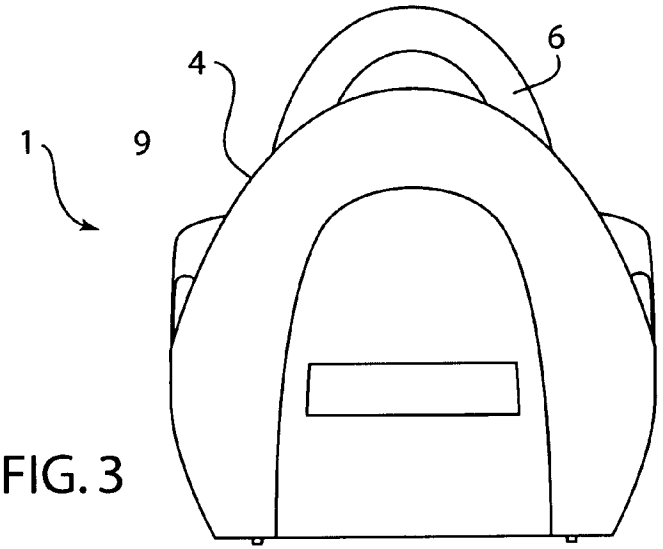
FIG. 3 is a rear elevational view of the marine seat of FIG. 1.
Figure 4:
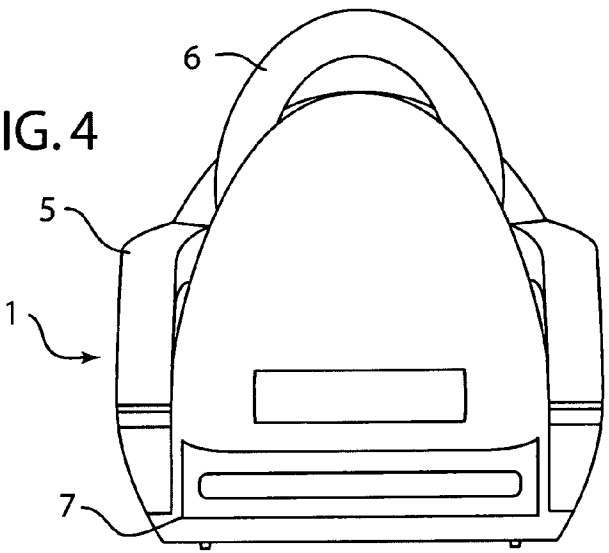
FIG. 4 is a front elevational view of the marine seat of FIG. 1.
Figure 1:
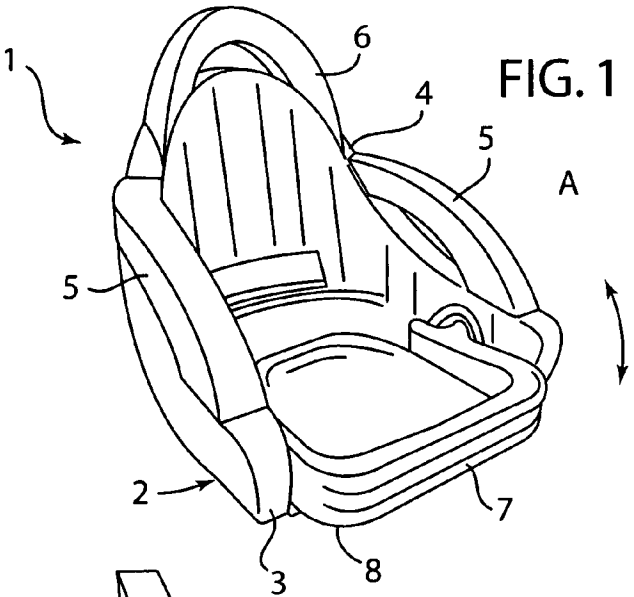
FIG. 1 is a perspective view of a marine seat according to one aspect of the present invention.
Figure 2:
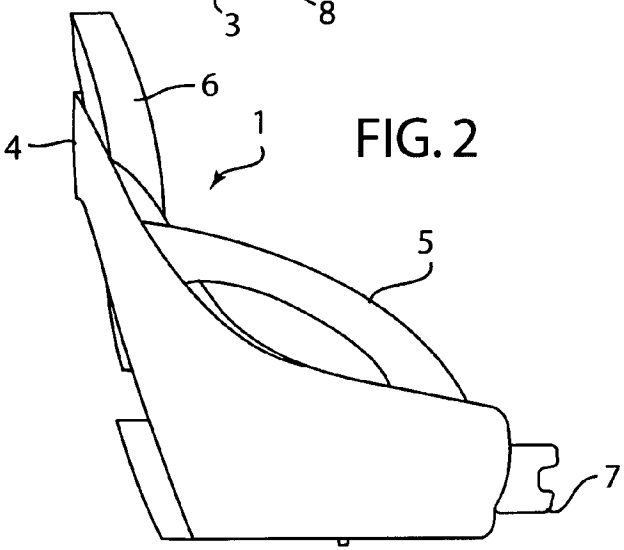
FIG. 2 is a side elevational view of the marine seat of FIG. 1.

For purposes of description herein, the terms "upper, " "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIGS. 1-5, a marine seating unit 1 according to one aspect of the present invention includes a primary structural member 2 including a forwardly projecting portion forming a seat 3 and a generally upright back 4. Armrests 5 and head rest 6 are secured to the primary structural member 2. The primary structural member 2, armrests 5, and head rest 6 are all hollow molded utilizing a blow-molding or other suitable process utilizing a polymer material such as polyethylene, polypropylene or other suitable material. The polymer material may include glass fibers to provide additional strength. A bolster 7 is pivotably mounted to the primary seat structure 2. As discussed in more detail below, bolster 7 can be rotated upwardly 105° to the position "A" (FIG. 2) to provide additional space for a user to stand in front of the seating unit 1 during operation of a boat. A seat pan 8 may be secured to the primary structural member 2, and a cover panel 9 may be secured to cover the back 4 of primary structural member 2. The seating unit 1 may be mounted to a pedestal 10 for mounting to a floor 11 of a boat. As discussed in more detail below, the armrests 5, head rest 6, cover panel 9 and seat pan 8 may have a variety of different configurations, such that the configuration and appearance of the marine seating unit 1 may be readily changed as illustrated in FIGS. 6A-6I. Thus, a single primary structural member 2 can provide for marine seating units 1A-1I having a wide variety of configurations as required for various applications.

Figure 5:
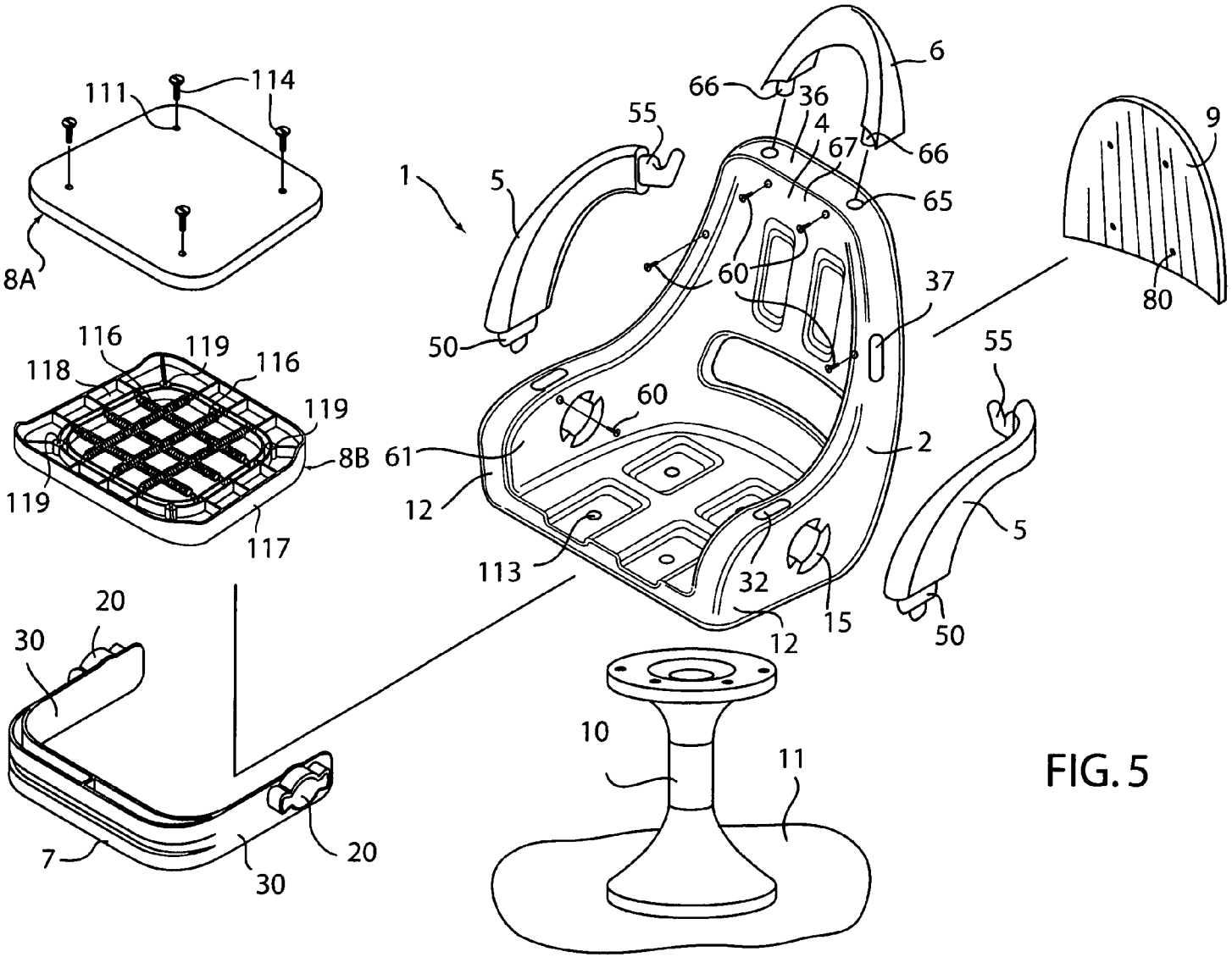
FIG. 5 is an exploded perspective view of the marine seat of FIG. 1.
Figure 5D:
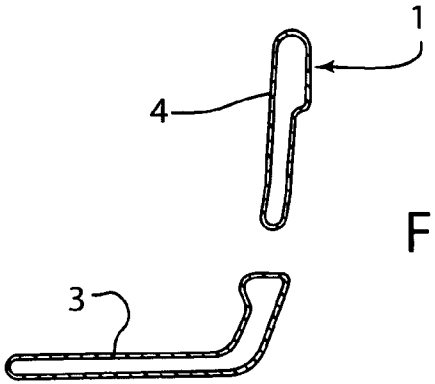
FIG. 5D is a cross-sectional view taken along the line VD-VD.
Figure 5E:
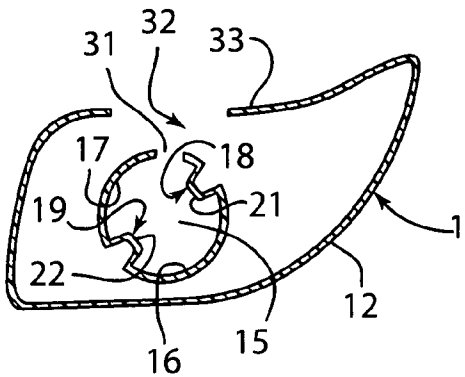
FIG. 5E is a cross-sectional view taken along the line VE-VE.
Figure 5A:
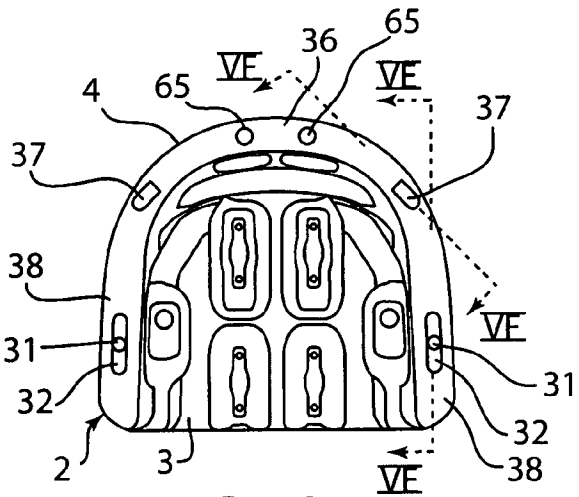
FIG. 5A is a top plan view of the primary seat structure of the marine seat of FIG. 5.
Figure 5B:
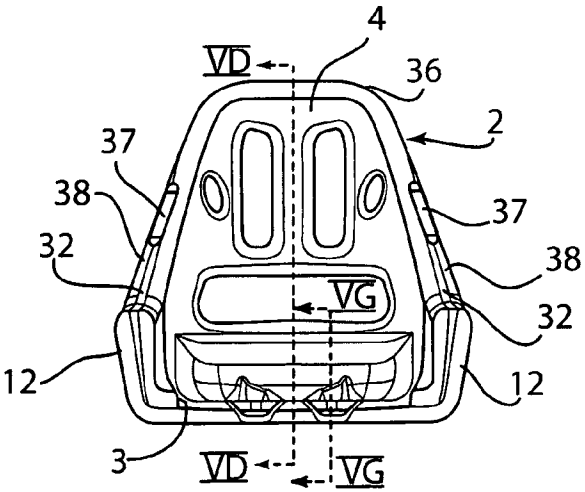
FIG. 5B is a front elevational view of the primary seat structure of FIG. 5A.
Figure 19:
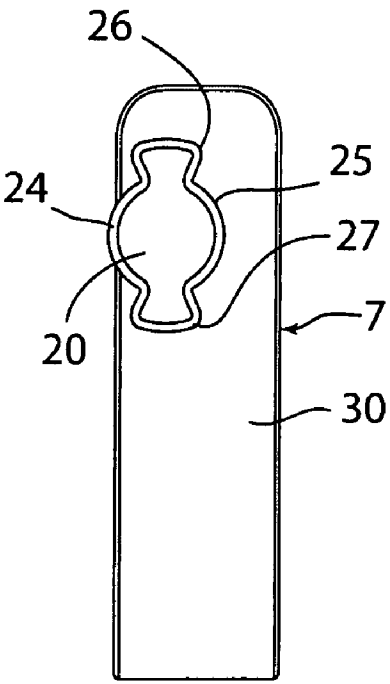
FIG. 19 is a side elevational view of the bolster of FIG. 18.
Figure 18:
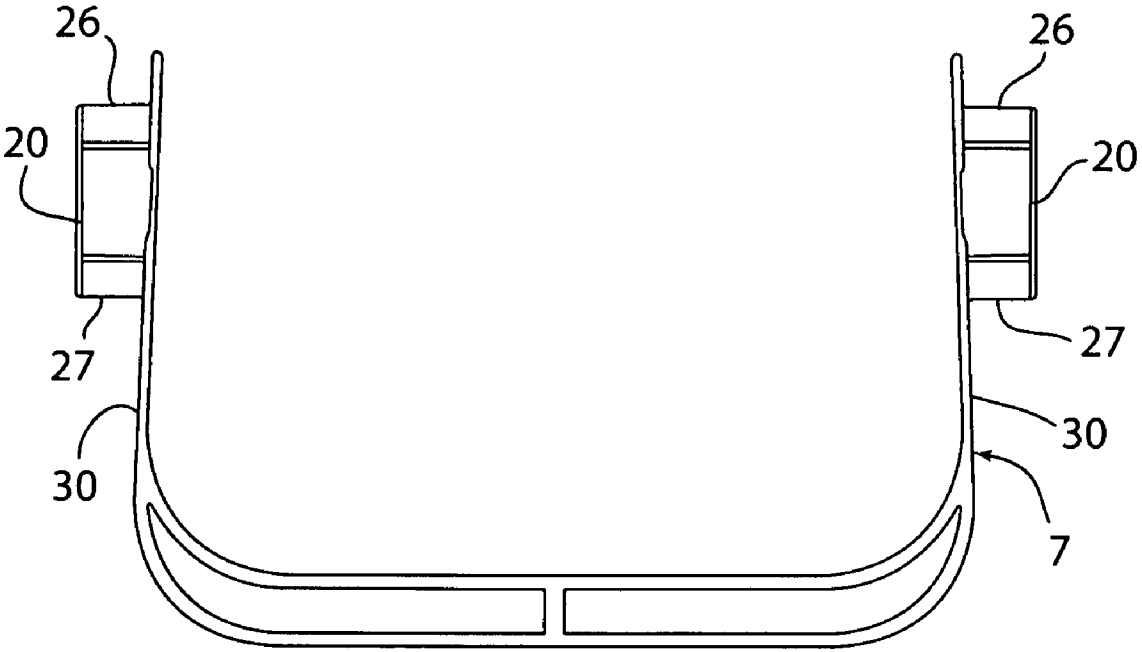
FIG. 18 is a plan view of the bolster of FIG. 5.
Figure 20:
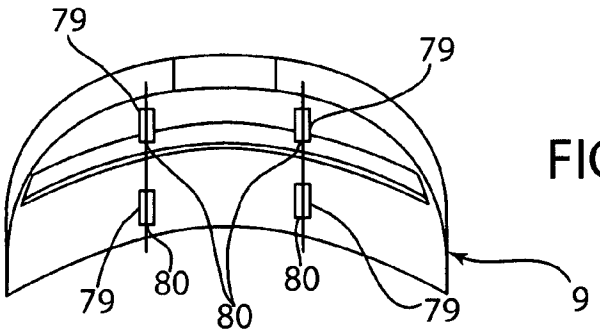
FIG. 20 is a top elevational view of a decorative back cover for the marine seating unit of FIG. 5.
Figure 21:
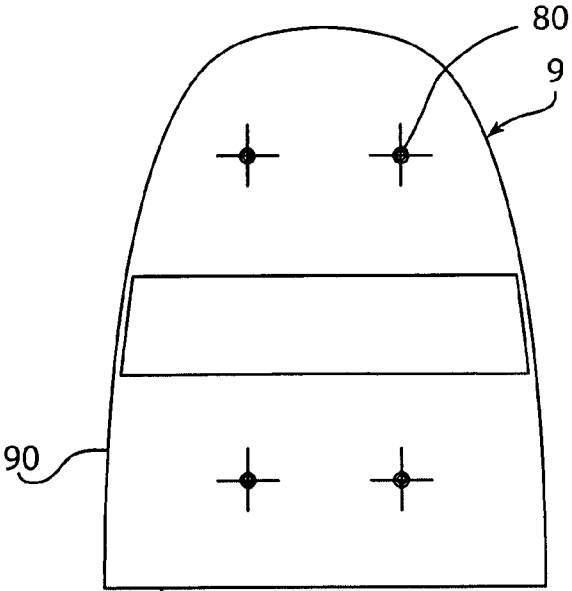
FIG. 21 is a front elevational view of the back cover of FIG. 20.
Figure 22:
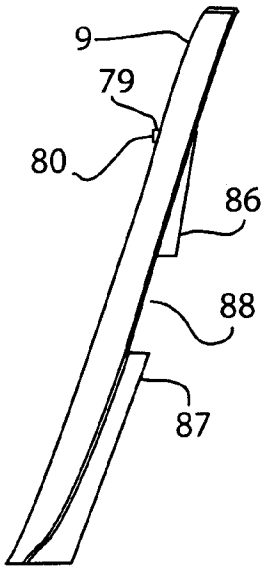
FIG. 22 is a side elevational view of the back cover of FIG. 21.
Figure 23:
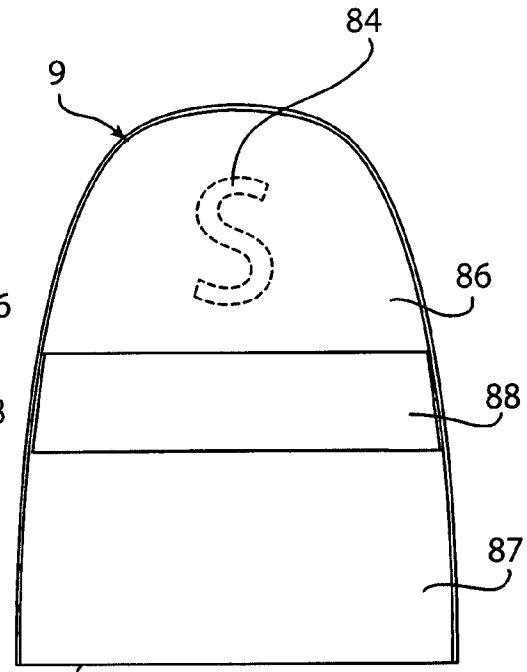
FIG. 23 is a rear elevational view of the back cover of FIG. 22.

With reference to FIGS. 5A and 5B, the primary structural member 2 has a blow-molded hollow construction (see also FIG. 5D), and includes upwardly extending side wall portions 12 that are formed integrally with the seat 3 and back 4. In the illustrated example, the primary structural member 2 has a wall thickness of 0.150 inches. With further reference to FIG. 5E, an opening 15 is formed in the inner wall 13 of side walls 12 of primary structural member 2. Opening 15 includes arcuate wall sections 16 and 17, and inwardly extending portions 18 and 19 having arcuate end surfaces 21 and 22, respectively. When assembled, the extensions 20 of bolster 7 (FIGS. 18 and 19) are received in openings 15, and the side surfaces 24 and 25 of extensions 20 slidably engage the end surfaces 21 and 22 of inwardly extending portions 18 and 19 to thereby rotatably mount the bolster 7 to the primary structural member 2. Transverse portions 26 and 27 of extensions 20 of bolster 7 are positioned adjacent the arcuate wall section 16 and 17, and the transverse portions 26 and 27 contact the extended portions 18 and 19 to limit the rotation of the bolster 7. In the illustrated example, the bolster 7 can be rotated from a lowered position (FIG. 1) wherein the bolster 7 is immediately in front of the seat 3 to an upright or raised position "A" wherein the arms are rotated 105° (e.g., 15° to the rear relative to a vertical plane) from the lowered position illustrated in FIG. 1. The arms 30 of bolster 7 are relatively narrow, and fit between upwardly extending side walls 12 of primary structural member 2 and seat pan 8. A circular hole 31 is formed in wall section 17 (FIG. 5E), and a slot 32 is machined through the side wall 33 (see also FIG. 5A). As discussed in more detail below, the slot 32 receives an end portion 50 (FIG. 9) of armrest 5, and hole 31 receives the smaller end portion 51 of armrest 5.

With reference back to FIGS. 5A and 5B, back 4 of primary structural member 2 includes an upper edge 3. A pair of female structural members in the form of openings 37 through surface 36 are provided.

Figures 7, 8, 9, 10, 11, 12:
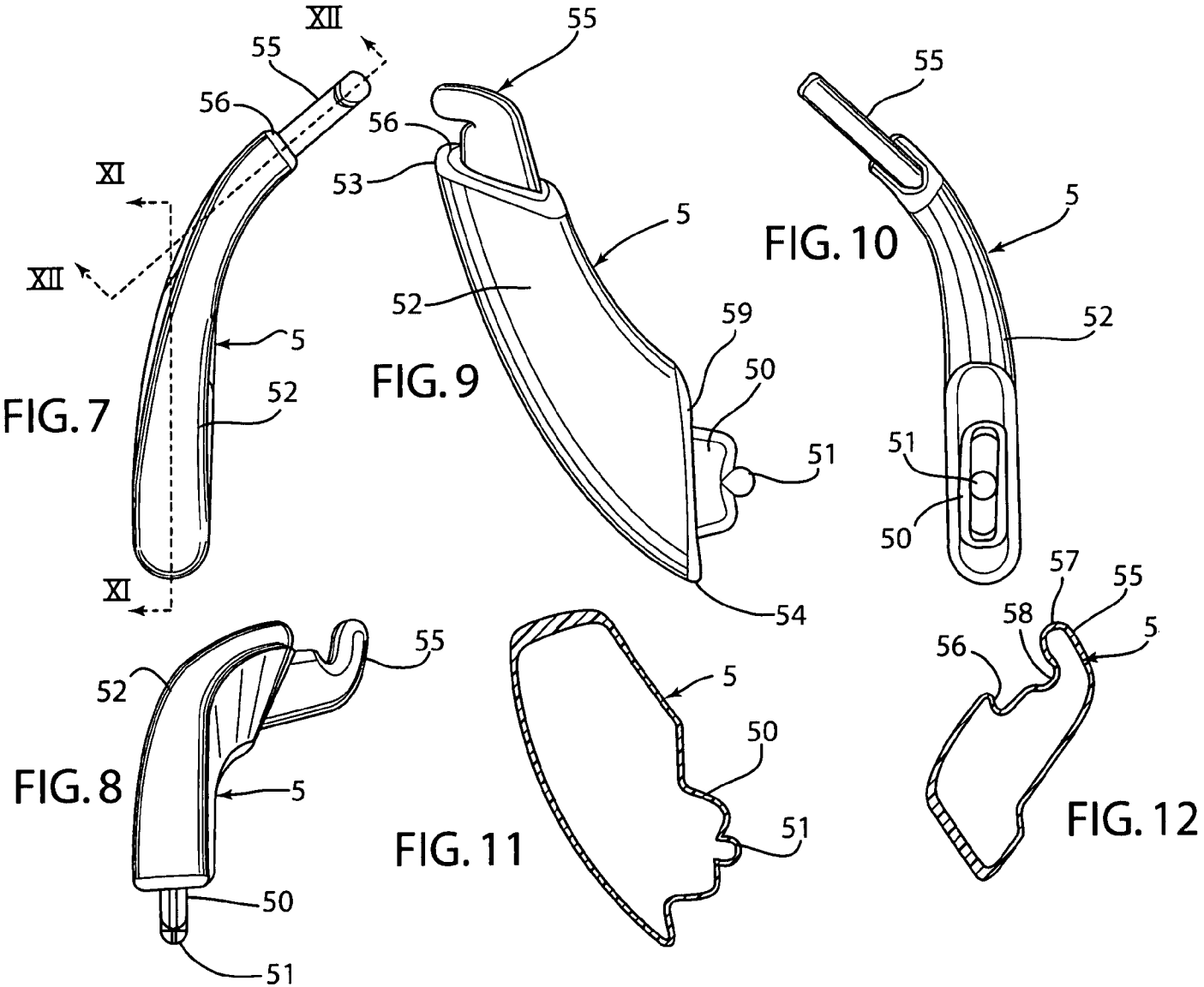
FIG. 7 is a top plan view of an armrest for a marine seat according to one aspect of the present invention.
FIG. 8 is a front elevational view of the armrest of FIG. 7.
FIG. 9 is a side elevational view of the armrest of FIG. 7.
FIG. 10 is a bottom plan view of the armrest of FIG. 7.
FIG. 11 is a cross-sectional view of the armrest of FIG. 7 taken along the line XI-XI.
FIG. 12 is a cross-sectional view of the armrest of FIG. 7 taken along the line XII-XII.

With reference to FIGS. 7-12, an armrest 5 according to one aspect of the present invention includes a main body portion 52, a first end 53 and a second end 54. First end 53 includes a hook 55 and a shoulder surface 56. With further reference to FIG. 12, the hook 55 includes a transversely extending end portion 57, and a concave surface portion 58. Second end 54 of armrest 5 includes a first end portion 50 (FIG. 11) having an elongated cross-sectional shape (FIG. 10), and a second end portion 51 has a circular cross-sectional shape.

During assembly, the hook 55 is inserted into the openings 37 (FIG. 5A) of primary structural member 2, and the end 54 of armrest 5 is then rotated downwardly until end portion 50 is received in slot 32 and second end portion 51 is received in opening 31 when assembled, shoulder surface 59 of armrest 5 contacts upper surface 38 of upwardly extending walls 12 of primary structural member 2. With reference back to FIG. 5, threaded fasteners 60 may then be driven through side walls 13 of upwardly extending walls 12. Fasteners 60 may also be driven through side walls 61 of back 4 into end portions 50 and hook 55 of armrests 5 to thereby securely interconnect the armrests 5 to the primary structural member 2.

As illustrated in FIG. 5, head rest 6 may include extensions 66 that are received in openings 65 in upper edge 36 of back 4. Head rest 6 has a blow-molded construction that is somewhat similar to that of armrests 5. After insertion of extension 66 in openings 65, threaded fasteners 60 may be driven through front side wall 67 of back 4 and into extensions 66 of head rest 6 to thereby secure the head rest 6 to the primary structural member 2.

Figure 15:
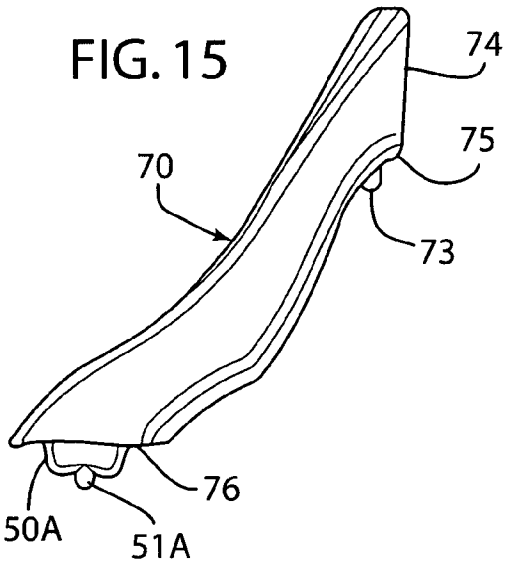
FIG. 15 is a side elevational view of the combination head rest and armrests of FIG. 13.
Figure 17:
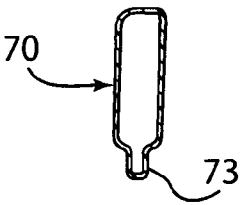
FIG. 17 is a cross-sectional view taken along the line XVII-XVII.
Figure 16:
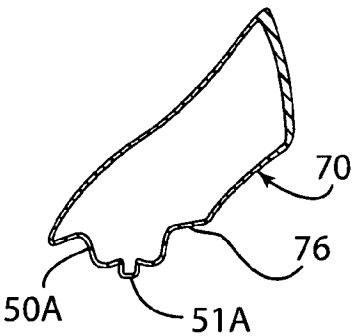
FIG. 16 is a cross-sectional view taken along the line XVI-XVI.
Figure 13:
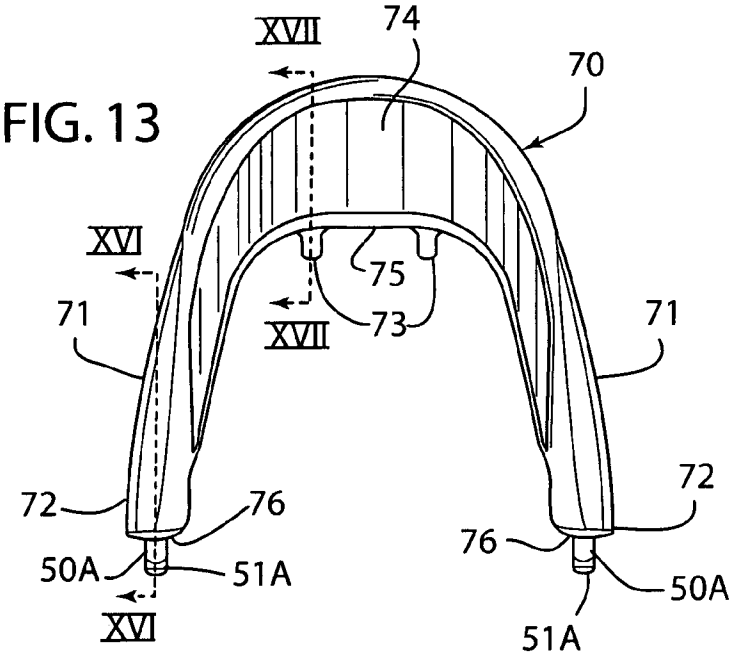
FIG. 13 is a front elevational view of a combination head rest and armrests.
Figure 14:
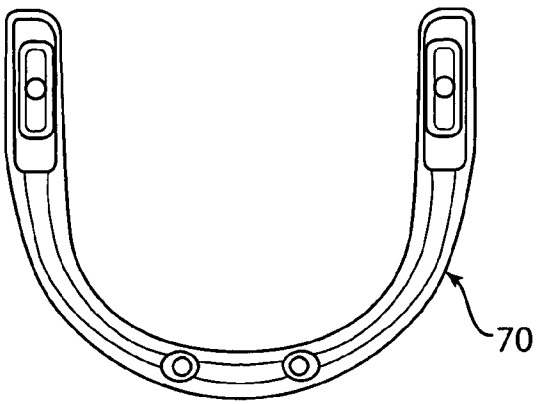
FIG. 14 is a bottom plan view of the combination head rest and armrests of FIG. 13.

With further reference to FIGS. 13-15, a combination head rest/armrest unit 70 may be installed to the primary structural member 2 instead of the armrests 5 and head rest 6 described above. The combination head rest/armrest unit 70 provides a substantially different configuration utilizing the same primary structural member 2. Head rest/armrest unit 70 has a blow-molded construction with an enlarged upside down U-shape. Unit 70 has an upper portion 74 forming a head rest and downwardly extending portions 71 that form armrests. Ends 72 of downwardly extending portions 71 include connectors 50A and 51A that are substantially similar to connectors 50 and 51, respectively of armrest 5 (see also FIG. 16). A pair of extensions 73 extend downwardly from lower edge 5 of head rest/armrest unit 70 adjacent the head rest or upper portion 74 (see also FIG. 17). The combination head rest/armrest unit 70 is secured to the primary structural member 2 by inserting end portion 50A into slot 37, with end portion 51A received in hole 31 and shoulder surface 76 contacting upper surface 38 of primary structural member 2. Extensions 73 are inserted into openings 65 in upper edge 36 of back 4 of primary structural member 2. Threaded fasteners 60 are driven through side wall 61 into end portions 50A, and threaded fasteners 60 are driven through side wall 67 of back 4 into extension 73 to thereby secure combination head rest/armrest unit 70 to the primary structural member 2.

Figure 5C:
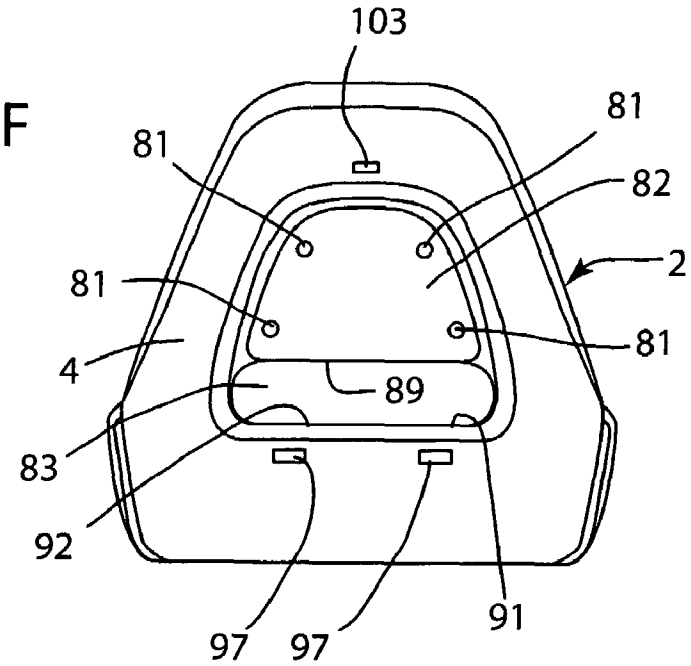
FIG. 5C is a rear elevational view of the primary structural member of FIG. 5B.
Figure 5F:
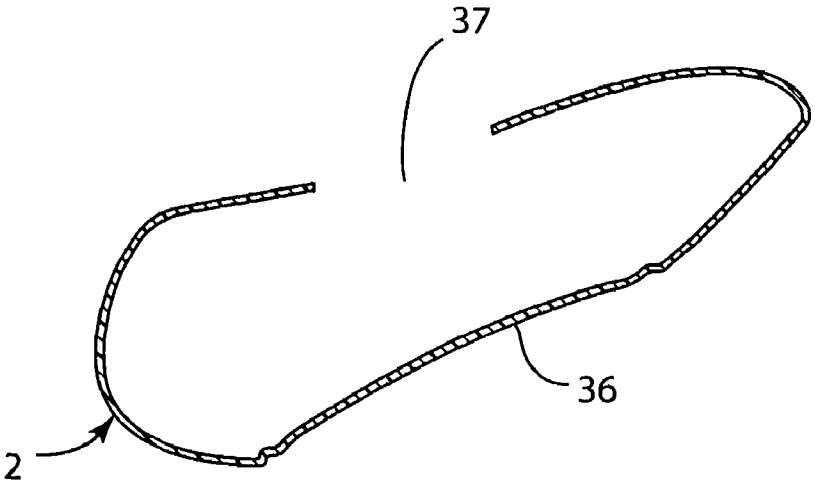
FIG. 5F is a cross-sectional view taken along the line VF-VF.

With further reference to FIGS. 20-23, cover panel 9 includes a plurality of bosses 79, each of which includes an opening 80. The openings 80 are configured to receive a commercially available "Wendy clip". The Wendy clips are a metal "Christmas tree" type fasteners that are secured in openings 81 (FIG. 5C) in the back 4 of primary structural member 2. During assembly, Wendy clips are installed in openings 80. Cover panel 9 is then secured to back 4 by inserting the Wendy clips into openings 81 (FIG. 5C) in back 4. When installed, cover panel 9 is positioned in recess 82 of back 4 above opening 83 in back 4. Cover panel 9 may have a company logo 84 or other design molded into the panel 9. Primary structural member 2 can thereby be readily customized for a particular manufacturer or application by utilization of an appropriate cover panel 9 having a logo 84 or other design features. In the illustrated example, cover 9 includes raised areas 86 and 87 forming a horizontal slot 88 therebetween to provide a decorative appearance. The lower edge 85 of cover 9 extends immediately adjacent upper edge 89 (FIG. 5C) of opening 83 through back 4 of primary structural member 2. Alternately, panel 9 could be configured such that the peripheral edge 90 closely matches the edge 91 of recess 82 in back 4, with lower edge 85 of panel 9 positioned along the lower edge 92 of recess 82 to thereby close off opening 83 through back 4. Also, panel 9 may have a flat configuration (i.e., without raised portions 86 and 87) to thereby provide a smooth appearance.

Figure 25:
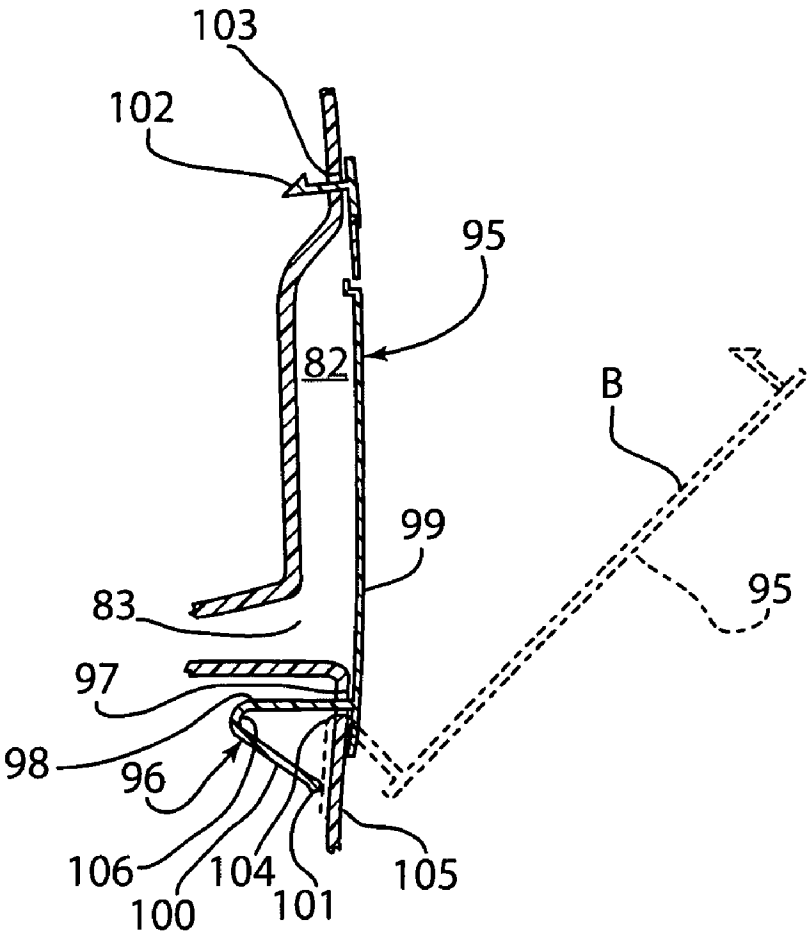
FIG. 25 is a partially fragmentary, cross-sectional view of the cargo door of FIG. 24 taken along the line XXV-XXV.
Figure 24:
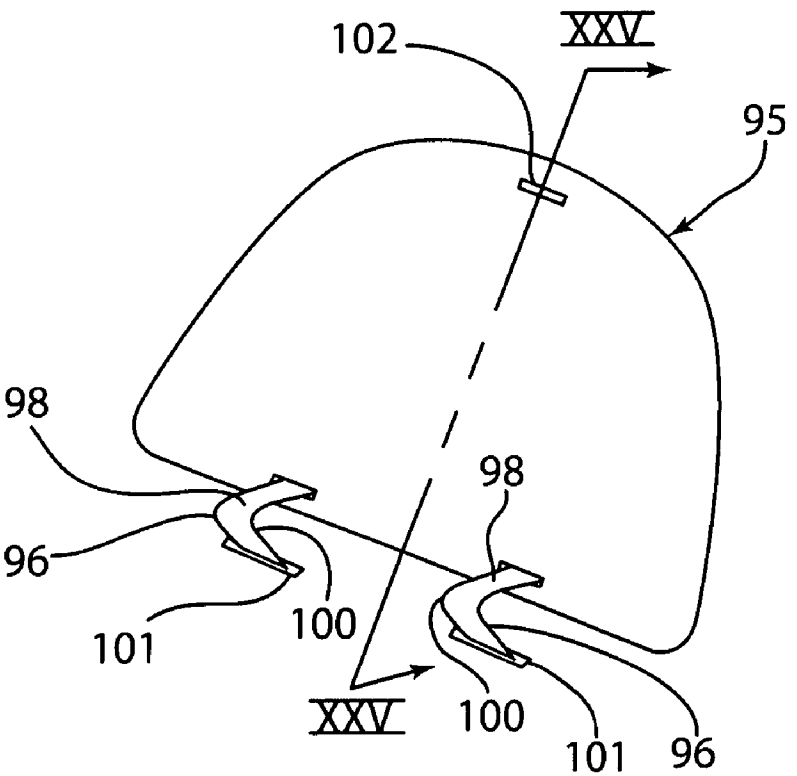
FIG. 24 is a perspective view of a back cover that pivots outwardly to provide a cargo door.

With further reference to FIGS. 24 and 25, instead of a cover panel 9, a cargo door 95 may be pivotably attached to the back 4 of primary structural member 2. Cargo door 95 is made of a polymer material that is somewhat flexible, and includes a pair of hinge members 96 that are inserted into slots 97 (FIG. 5C) adjacent opening 83 in back 4. Each hinge member 96 includes a portion 98 that extends transversely from the main wall 99 of cargo door 95, and an end portion 100 that extends toward wall 99 at an angle. Transverse end extensions 101 have a cylindrical shape and a width that is somewhat greater than that of slots 97. Cargo door 95 is initially installed to back 4 by twisting the hinge members 96 to permit insertion of the ends 101 through slots 97 in back 4. A barbed connector 102 is received in an opening 103 to thereby retain the cargo door in the upright position illustrated in FIG. 25. When in the closed position, the horizontal portion 98 of hinge member 96 contacts edge 104 of opening 97. Cargo door 95 may be opened to the position designated "B" (FIG. 25) by pulling on the door 95 to release barbed connector 102. In the opened position, the end portion 100 of hinge member 96 abuts the inside of side wall 105 of back 4, and inner corner 106 of hinge member 96 contacts edge 104 of opening 97 to thereby retain the cargo door 95 in the opened position B.

Figure 5G:
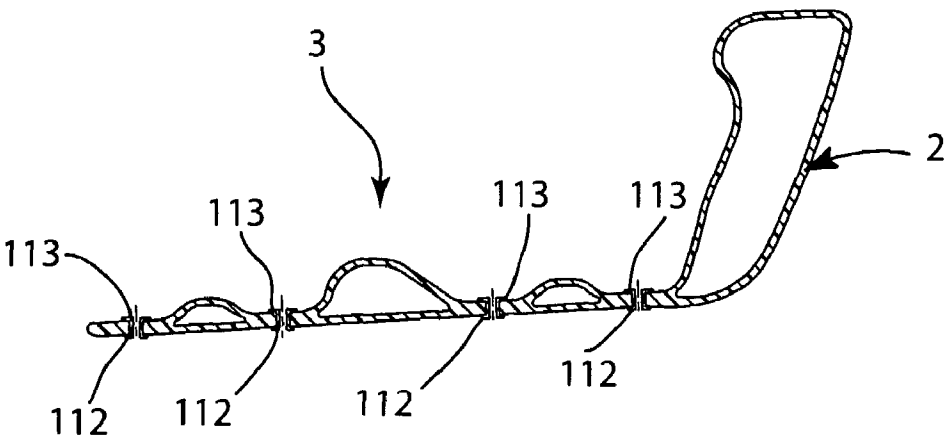
FIG. 5G is a cross-sectional view taken along the line VG-VG.
Figure 6G:
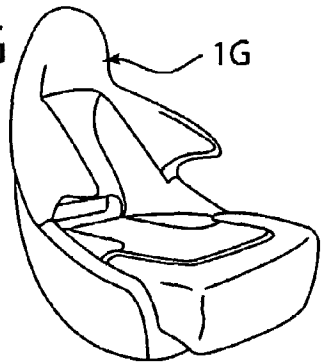
FIGS. 6A-6I are perspective views of seats according to various aspects of the present invention.
Figure 6H:
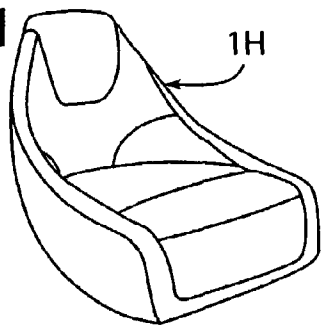
Figure 6I:
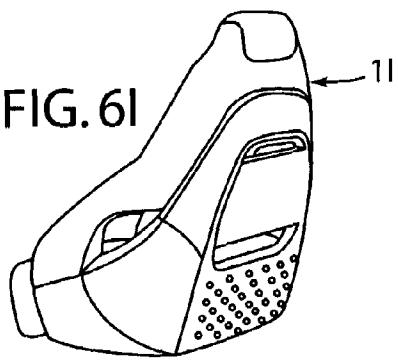
Figure 6D:
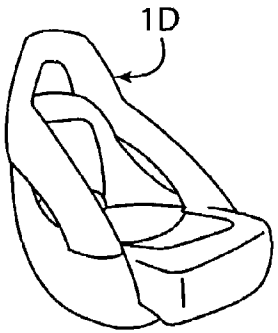
Figure 6E:
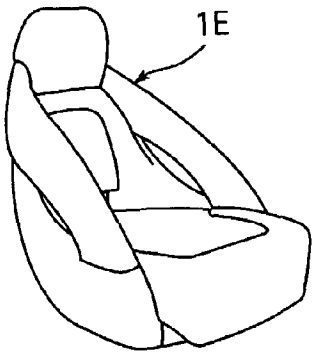
Figure 6F:
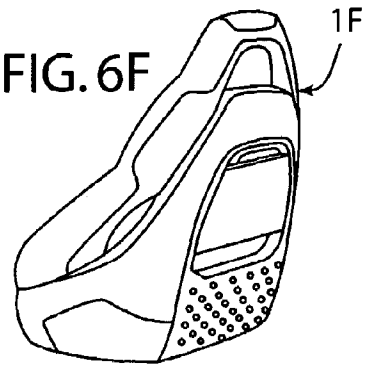
Figure 6A:
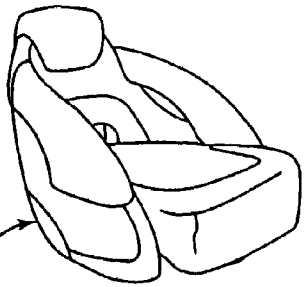
Figure 6B:
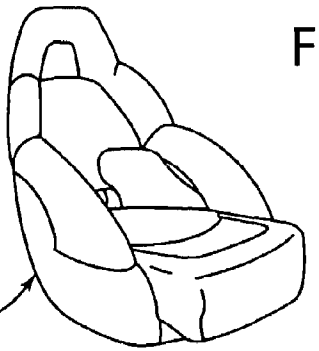
Figure 6C:
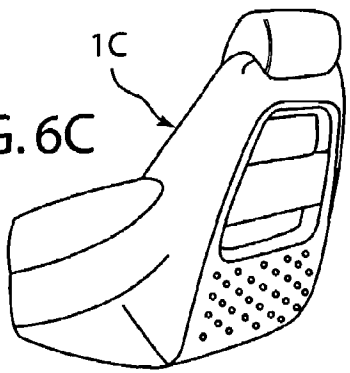
Figure 27:
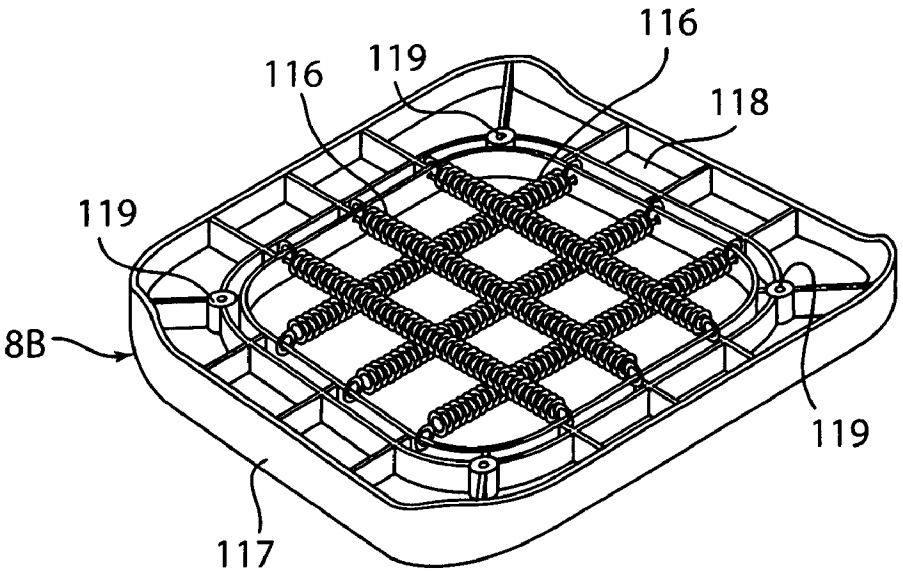
FIG. 27 is a perspective view of a seat pan according to another aspect of the present invention.
Figure 26:
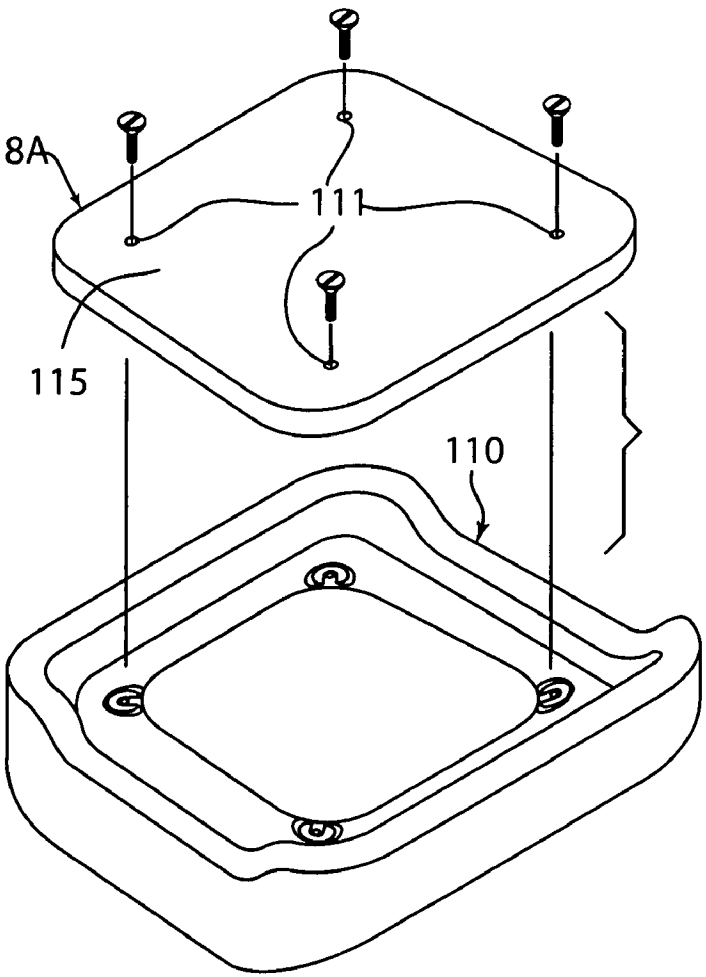
FIG. 26 is a perspective view of a seat pan according to one aspect of the present invention.

Seat pan 8 may comprise a "non-SAS" seat pan 8A (FIG. 26), or it may comprise a "SAS" seat pan 8B (FIG. 27). The seat pan 8A comprises a horizontal sheet portion 110 having a plurality of openings 111 therethrough. With reference back to FIG. 5G, seat portion 3 of primary structural member 2 includes a plurality of openings 112, each of which receives a rivet style T-nut 113. When assembled, threaded fasteners 114 (FIG. 5) extend through openings 111 and engage T-nuts 113 to secure seat pan 8A to seat 3 of primary structural member 2. Seat pan 8A may be covered by foam 115 (FIG. 26) and upholstered as illustrated in FIGS. 6A-6I.

Alternately, seat pan 8 may comprise a "SAS" seat pan 8B (FIG. 27) having a generally rectangular perimeter 117 and an enlarged rectangular opening 118 through the central portion of the seat pan 8. A plurality of springs 116 extend across the opening 118 to provide a suspended seat construction. A plurality of openings 119 receive threaded fasteners 114 to secure the seat pan 8 in a substantially similar manner as described above in connection with seat pan 8A. Seat pan 8B may also be covered with foam 115 and upholstered.

After the armrest 5 and head rest 6 (or combination head rest/armrest unit 70), seat pan 8A or 8B and bolster 7 are secured to the primary structural member 2, the armrest 5, seat pan 8A or 8B, head rest 6, and primary structural member 2 can be covered with a layer of foam and upholstered in a conventional manner as illustrated in FIGS. 6A-6I.

The armrests 5 can be quickly and securely attached to the primary structure 2 utilizing the male connectors and female connector structures described above. Similarly, the head rest 6 can also be quickly and easily connected to the primary structure 2. Alternately, the combination head rest/armrest unit 70 may be quickly connected to the primary structure 2 utilizing the male connecting structures received in the openings in primary structure 2. The marine seating unit 1 of the present invention may be readily adapted and reconfigured as required for a particular application. The primary structural member 2 can be utilized for receiving a wide variety of armrest and head rest styles. Also, a variety of cover panels 9 may be secured to the back of the primary structural member to provide a variety of visual arrangements, or a cargo door may be secured to the seat back to provide for storage. Different types of seat pans may be secured to the primary structural member 2 to thereby provide the proper cushioning characteristics for a particular application. Still further, a combination head rest and armrest unit may also be secured to the primary structural member to provide yet another visual and functional variation. The marine seating unit 1 of the present invention can be readily configured to provide a wide range of visual and functional variations, without requiring complete re-tooling of the entire seating unit.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A seat for marine use, comprising:

a primary seat structure including a hollow back portion and a hollow seat portion extending forwardly therefrom, the primary seat structure including a sidewall defining inner and outer sidewall surfaces with a plurality of first connector openings through the sidewall, and a plurality of second connector openings;

a pair of armrests, each having a body and hook-shaped connectors at first ends thereof, wherein the hook-shaped connectors include longitudinally-extending first portions and end portions extending transversely from the first portions, wherein the hook-shaped connectors are received in the first connector openings with the end portions thereof engaging the inner sidewall surfaces adjacent the first connector openings, the armrests including male connectors at second ends thereof received in the second connector openings, wherein the armrests are non-resilient, and capable of being assembled to the primary seat structure without flexing the armrests by first inserting a selected one of the hook-shaped connectors and the male connectors into the first connector openings, followed by insertion of the other of the hook-shaped connectors and the male connectors into the second connector openings.

2. The seat of claim 1, wherein:

the armrests are made of a polymer material, and the body and hook-shaped connectors have a hollow construction.

3. The seat of claim 1, wherein:

the hook-shaped connectors are integrally formed with the bodies of the armrest and extend upwardly within the first connector openings.

4. The seat of claim 1, wherein:

the first openings are positioned on the side edge surfaces and face outwardly.

5. The seat of claim 4, wherein:

the armrests include an elongated body portion, and the hook-shaped connectors extend horizontally transverse to the elongated body, and include an upwardly extending end portion.

6. A seat for marine use, comprising:

a one-piece polymer seat having a hollow upright back portion and an integral hollow seat portion extending transversely relative to the upright back portion, wherein the back portion defines a forwardly-facing front face, a rearwardly-facing rear face, and generally vertical outwardly-facing opposed side edge surfaces extending between the front and rear faces, each side edge surface having a first connector opening therein, the seat further including integrally-formed lateral support sidewalls extending upwardly from opposite sides of the seat portion such that the seat portion and the sidewalls together define a shallow U-shape in cross section, and wherein the lateral support sidewalls are integrally formed with the back portion, each lateral support sidewall defining an upwardly-facing upper edge surface having a second connector opening therein;

a pair of armrests, each having a one-piece polymer construction with an elongated hollow body defining a cavity and including integrally-formed connectors at opposite ends; and wherein the integrally-formed connectors are received in the first and second connector openings.

7. The seat of claim 6, wherein:

at least one integrally-formed connector of each armrest is hollow and defines a connector cavity that is fluidly connected to the cavity of the hollow body.

8. The seat of claim 6, wherein:

at least one of the first and second connector openings has an oblong shape, and selected ones of the connectors are received in the openings and have an oblong cross-sectional shape closely corresponding to the oblong shape of the one connector opening.

9. The seat of claim 6, wherein:

the body of each armrest defines a curvilinear centerline extending lengthwise along the body and wherein each body has an oblong cross-sectional shape having a first dimension in a first direction that is substantially greater than a second dimension in a second direction, the cross-sectional shape defining a major axis aligned with the first direction and a minor axis that is orthogonal to the major axis and aligned with the second direction, at least one of the connectors having a cantilevered protrusion extending transversely relative to the curvilinear centerline in the first direction to form a hook.

10. The seat of claim 9, wherein:

the curvilinear centerlines have generally vertical lower end portions at a connector received in the second connector openings, curved center portions extending from the lower end portions to upper end portions that extend horizontally inwardly towards the first connector openings.

* * * * *